US008252154B2

(12) United States Patent
Cheng

(10) Patent No.: US 8,252,154 B2
(45) Date of Patent: Aug. 28, 2012

(54) ELECTROPLATING APPARATUS

(75) Inventor: Chien-Pang Cheng, Taoyuan (TW)

(73) Assignee: Zhen Ding Technology Co., Ltd., Tayuan, Taoyuan (TW)

( * ) Notice: Subject to any disclaimer, the term of this patent is extended or adjusted under 35 U.S.C. 154(b) by 164 days.

(21) Appl. No.: 12/913,782

(22) Filed: Oct. 28, 2010

(65) Prior Publication Data

US 2011/0233052 A1 Sep. 29, 2011

(30) Foreign Application Priority Data

Mar. 29, 2010 (CN) ..... 2010 2 0143752

(51) Int. Cl.
*C25D 17/06* (2006.01)
*C25D 17/08* (2006.01)

(52) U.S. Cl. ..... 204/224 R; 204/198; 204/242; 204/259; 204/267; 204/278.5; 204/286.1; 204/287; 204/297.01; 204/297.06; 204/297.15; 204/297.16

(58) Field of Classification Search ..... 204/198, 204/224 R, 242, 259, 267, 278.5, 279, 286.1, 204/287, 288, 288.4, 297.01, 297.06, 297.15, 204/297.16
See application file for complete search history.

(56) References Cited

U.S. PATENT DOCUMENTS

| | | | | |
|---|---|---|---|---|
| 3,880,725 | A * | 4/1975 | Van Raalte et al. | 205/95 |
| 4,828,654 | A * | 5/1989 | Reed | 205/97 |
| 4,964,964 | A * | 10/1990 | Murphy | 204/224 R |
| 6,224,721 | B1 * | 5/2001 | Nelson et al. | 204/272 |
| 8,177,945 | B2 * | 5/2012 | Arvin et al. | 204/242 |
| 2003/0051996 | A1 * | 3/2003 | Huens et al. | 204/237 |
| 2007/0144898 | A1 * | 6/2007 | Oldani et al. | 204/286.1 |

* cited by examiner

*Primary Examiner* — Bruce Bell
(74) *Attorney, Agent, or Firm* — Altis Law Group, Inc.

(57) ABSTRACT

An electroplating apparatus includes an electroplating tank, a first supporting bar, a first holding element, two second supporting bars, a number of spaced crossbars, a number of second holding elements, and a power supply. The first holding element is suspended in the tank from the first supporting bar, and the first holding element is configured for holding a plate-shaped workpiece in a manner that the workpiece is oriented along the first supporting bar. The second holding elements are suspended from the corresponding crossbars, each of the second holding elements arranged between the first and one of the second supporting bars and configured for holding a metal block. The power supply includes a cathode for electrical connection to the workpiece through the first supporting bar and the first holding element and an anode for electrically connection to the metal blocks through the second supporting bars and the second holding elements.

17 Claims, 4 Drawing Sheets

ELECTROPLATING APPARATUS

BACKGROUND

1. Technical Field

The disclosure relates to electroplating and, particularly, to an electroplating apparatus for applying a uniform layer on a surface of a workpiece.

2. Description of Related Art

Currently, electroplating is generally used for depositing a layer of material, such as metal on a surface of a workpiece of, for example, a printed circuit board (PCB). Electroplating apparatus often includes an electroplating tank with electrolyte solution received therein, an anode plate, a cathode plate, and a conductive clip. In operation, the workpiece is attached to the cathode plate by the clip, and an electric current is applied to the workpiece through the clip. However, a current density applied to the surface of the workpiece at a position close to the clip is generally greater than that at a position farther from the clip. That is, the current density applied to the surface of the workpiece is non-uniform and may result in non-uniform thickness of the metallic layer formed on the surface of the workpiece.

Therefore, what is needed is an electroplating apparatus which can overcome the limitations described.

DETAILED DESCRIPTION

Embodiments of the electroplating apparatus will now be described in detail below with reference to drawings.

Figure 1:
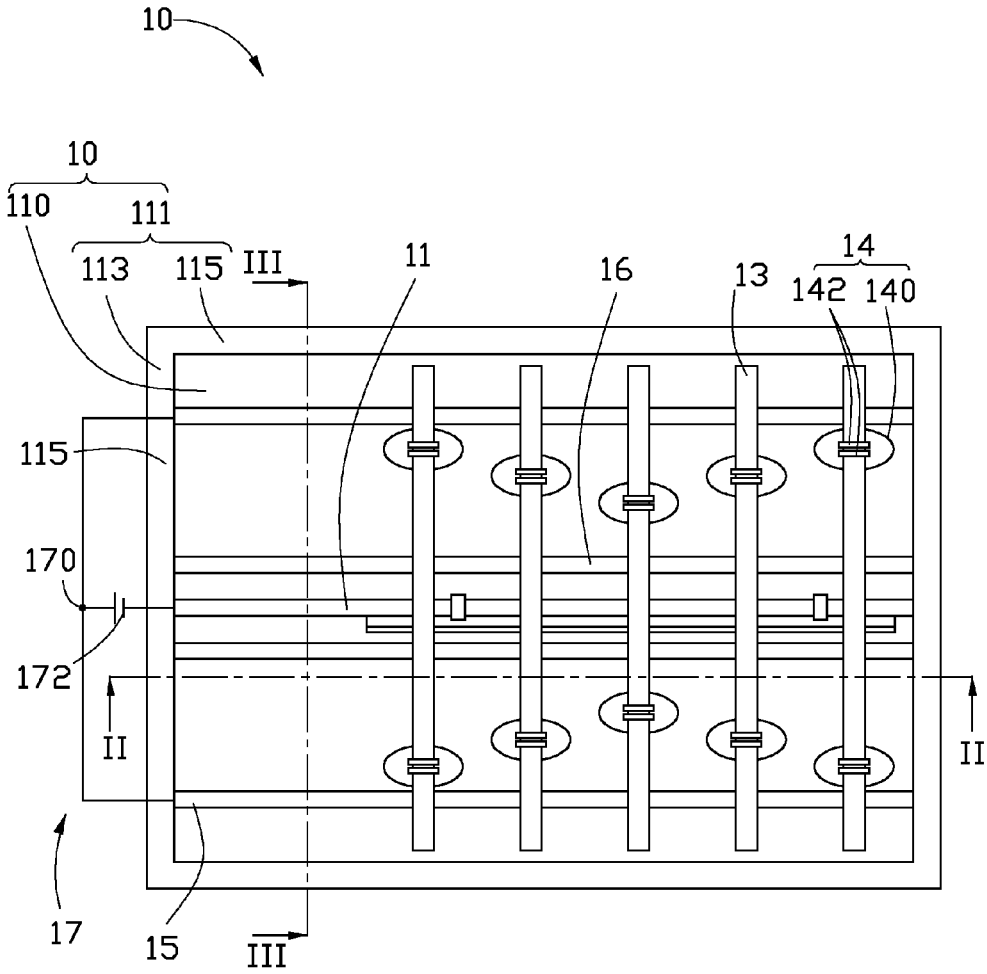
FIG. 1 is a top plan view of an electroplating apparatus according to an exemplary embodiment.
Figure 2:
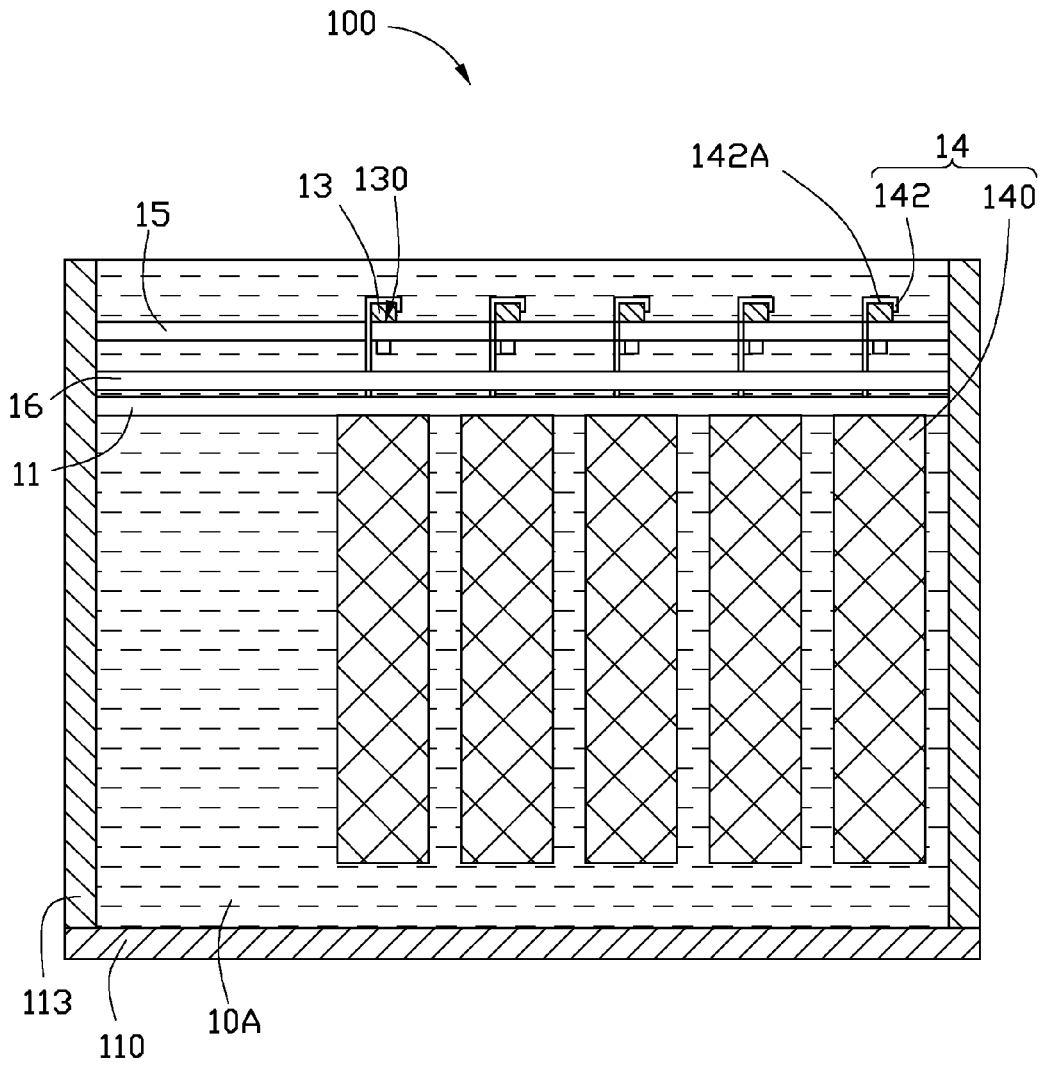
FIG. 2 is a sectional view of the electroplating apparatus of FIG. 1, taken along line II-II.
Figure 3:
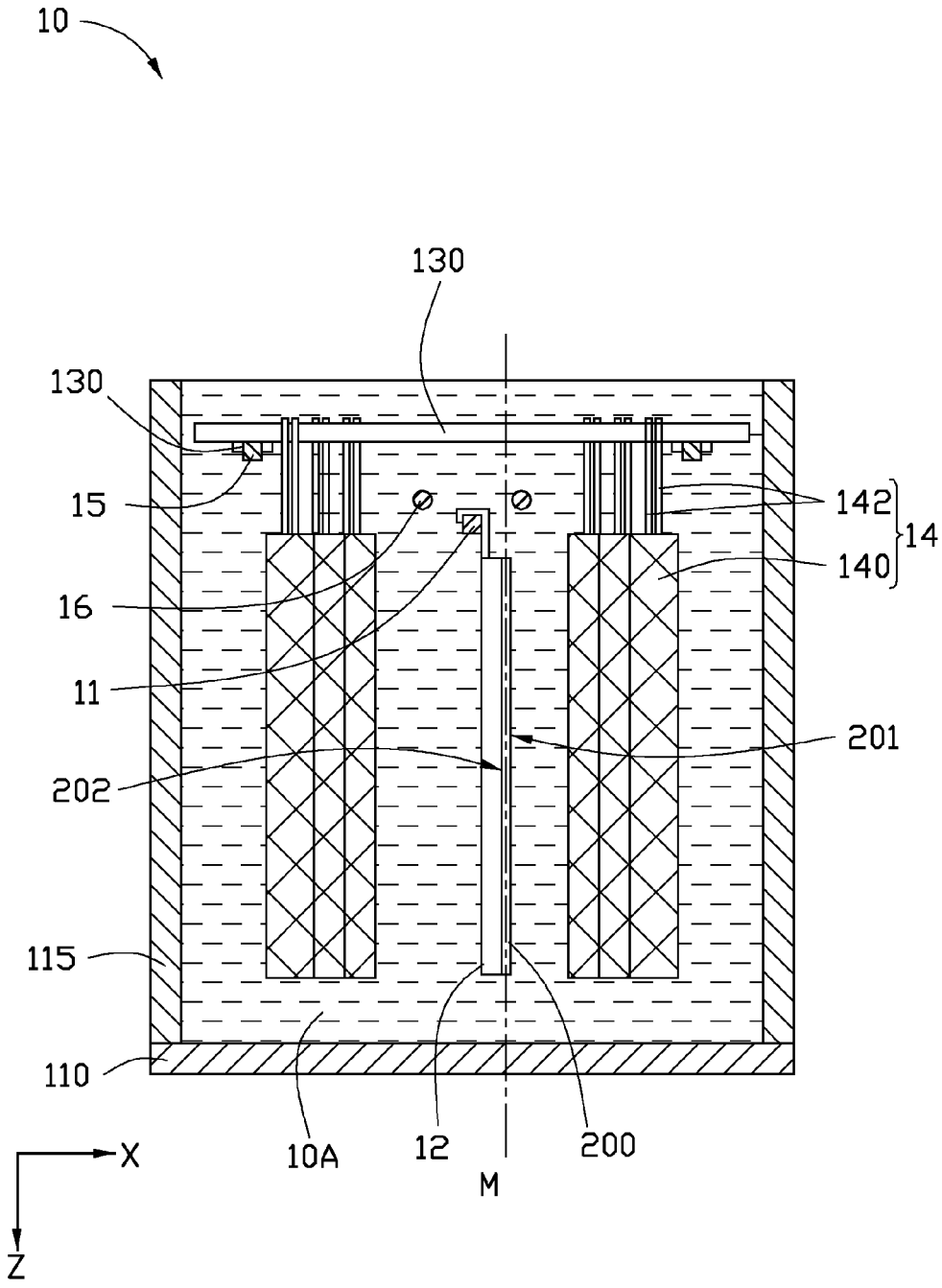
FIG. 3 is a sectional view of the electroplating apparatus of FIG. 1, taken along line III-III.

Referring from FIG. 1 to FIG. 3, an electroplating apparatus 100 according to an exemplary embodiment is shown. The electroplating apparatus 100 includes an electroplating tank 10, a first supporting bar 11, a first holding element 12, a number of crossbars 13, a number of second holding elements 14, two second supporting bars 15, and a power supply 17.

The tank 10 includes a baseboard 110 and a holder 111. The holder 111 extends upwardly from a peripheral portion of the baseboard 110. The tank 10 defines a central axis M (see FIG. 3). A cross-section of the tank 10 is substantially rectangular, and the holder 111 includes four exterior peripheral sidewalls, for example, two first peripheral sidewalls 113 in parallel and two second peripheral sidewalls 115 in parallel. Each of the second peripheral sidewalls 115 is located between and adjoins the two first peripheral sidewalls 113. In this embodiment, the two first peripheral sidewalls 113 are symmetrically opposite each other across the central axis M. The two second peripheral sidewalls 115 are symmetrically opposite across the central axis M.

As shown in FIG. 2 and FIG. 3, the electroplating tank 10 has an electrolyte solution 10A received therein. The first supporting bar 11, the first holding element 12, the crossbars 13, the second holding elements 14, and the second supporting bars 15 are immersed in the solution 10A.

The first supporting bar 11 is horizontally oriented, and extends between the two first peripheral sidewalls 113. In this embodiment, the first supporting bar 11 includes two opposite ends attached to the respective first peripheral sidewalls 113.

Figure 4:
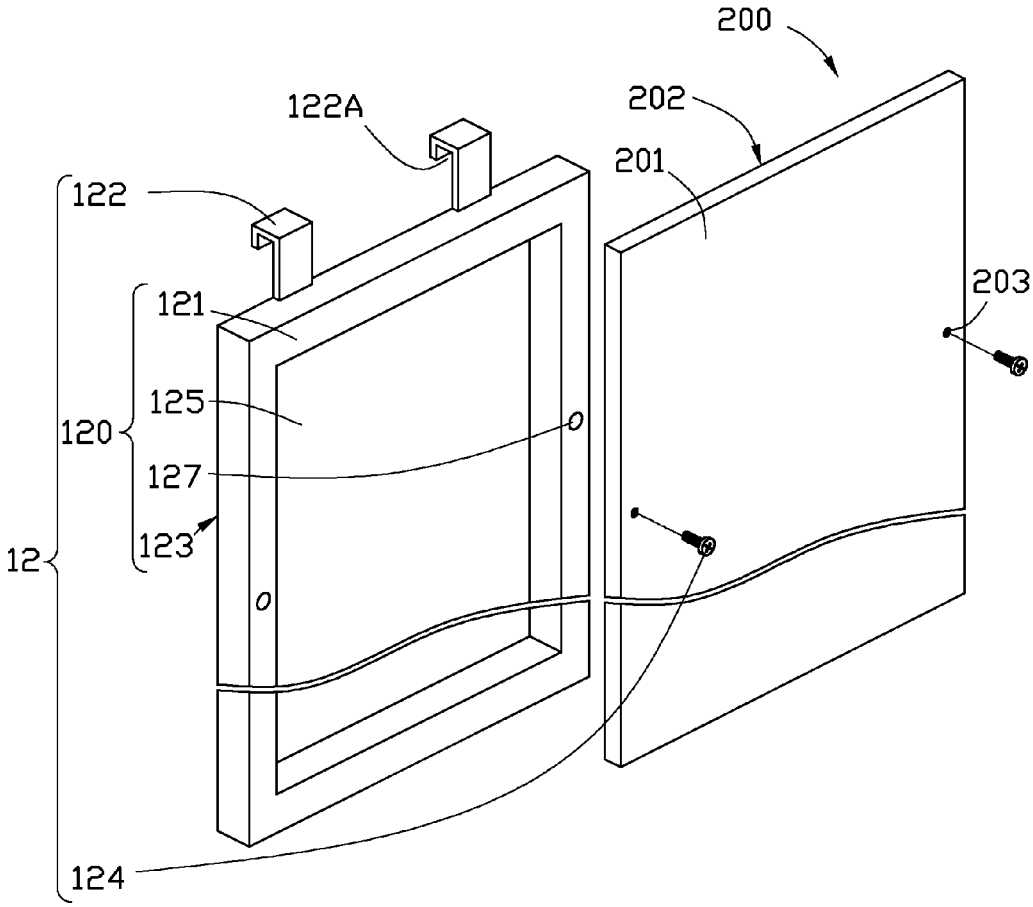
FIG. 4 is an isometric view of a first holding element of FIG. 1, together with a workpiece.

As shown in FIG. 4, the first holding element 12 is configured for holding a workpiece 200 to be processed in the solution 10A. In this embodiment, the workpiece 200 is rectangular plate-shaped, and includes a first surface 201 and a second surface 202 at two opposite sides thereof, and two first threaded holes 203 defined in the first surface 201. The two first threaded holes 203 are defined in two opposite edges of the workpiece 200 in the first surface 201. The first holding element 12 includes a holding frame 120, two first loops 122, and two fasteners 124. The frame 120 is shaped to conform to the workpiece 200. In this embodiment, the frame 120 is substantially cuboid, and includes a third surface 121 and a fourth surface 123 at two opposite sides thereof, a recess 125 and two second threaded holes 127 defined in the third surface 121. The recess 125 is defined in a central region of the third surface 121 and exposed at the fourth surface 123. The two second threaded holes 127 are defined in two opposite edges of the frame 120 in the third surface 121. The two fasteners 124 are threaded in the two respective first threaded holes 203 and the two respective second threaded holes 127, whereby the workpiece 200 is fixedly attached to the frame 120. In this embodiment, when the workpiece 200 is attached to the frame 120, a central region of the second surface 202 is exposed in the recess 125. Edge portions of the second surface 202 contact the third surface 121 of the first holding element 12. When the frame 120 is immersed in the solution 10A, both the first surface 201 and the second surface 202 fully contact the electrolyte solution 10A.

The two first loops 122 are attached to an edge of the frame 120, and are spaced from each other. Each of the two first loops 122 has a second slot 122A receiving the first supporting bar 11, thereby the two first loops 122 can be movable along the first supporting bar 11. The frame 120 can be slidably attached to the first supporting bar 11 by the two first loops 122. In alternative embodiments, each of the first holding elements 12 may include only a first loop 122. The number of the first loop 122 is not limited to the embodiments as disclosed.

In this embodiment, when the workpiece 200 is held by the first holding element 12 in the solution 10A, the first and the second surfaces 201, 202 of the workpiece 200 are substantially perpendicular to the baseboard 110. The workpiece 200 is movable along a common plane (not shown) passing through the central axis M (see FIG. 3).

The two second supporting bars 15 each are horizontally oriented, and arranged at two opposite sides of the first supporting bar 11. In this embodiment, each of the second supporting bars 15 includes two opposite ends attached to the two respective first peripheral sidewalls 113, and is substantially parallel to the first supporting bar 11. In addition, the two second supporting bars 15 are close to the two respective second peripheral sidewalls 115 and farther from the first supporting bar 11.

This embodiment includes five crossbars 13 spaced from one another substantially parallel to the first supporting bar 11 or the second supporting bar 15. The five crossbars 13 are substantially parallel and substantially perpendicular to the first supporting bar 11 or the second supporting bar 15. As show in FIG. 2 and FIG. 3, each of the crossbars 13 includes two first slots 130 defined in. The two first slots 130 snugly receive the two second supporting bars 15, thereby each crossbar 13 can be slidably attached to the two second supporting bars 15.

This embodiment includes ten second holding elements 14. Each crossbar 13 has two second holding elements 14 arranged thereon. Each of the second holding elements 14 includes a mesh container 140 and two second loops 142. In this embodiment, each of the two second loops 142 is attached to an end of the mesh container 140, and has a third slot 142A (see FIG. 3) receiving the crossbar 13. The mesh container 140 thereby is slidably attached to the corresponding crossbar 13 by the two second loops 142. In alternative embodiments, each of the second holding elements 14 may include only a second loop 142. The number of the second loop 142 is not limited to the above embodiments.

The mesh container 140 is elongated perpendicular to the baseboard 110 of the tank 10. A cross section of the mesh container 140 is substantially elliptical. The mesh container 140 has a first end (not shown) attached to the second loops 142, and an opposite second end to the first end distant from the second loops 142. The first end is opened toward the second loops 142. The second end is closed. In this embodiment, the mesh container 140 may include a number of metallic wires stainless steel, and a surface of each metallic wire may have a titanium layer formed thereon.

In this embodiment, the electroplating apparatus 100 is used to apply electroplating process to the workpiece 200, thereby a layer of metal is formed on the first and the second surfaces 201, 202. The mesh container 140 is used to receive the a metal block.

In this embodiment, ten second holding elements 14 are arranged in two groups at opposite sides of the workpiece 200. Five second holding elements 14 are arranged in one group and oriented toward the first surface 201. The other five second holding elements 14 are arranged in the other group and oriented toward the second surface 202. The second holding elements 14 of the two groups are symmetrical relative across the workpiece 200. The distance between the second holding elements 14 oriented toward the first surface 201 increase in directions from a vertical centerline of the first holding element 12 to opposite sides thereof. Similarly, the distance between the second holding elements 14 oriented toward the second surface 202 increase in directions from a vertical centerline of the first holding element 12 to opposite sides thereof.

In this embodiment, the electroplating apparatus 100 includes two blocking posts 16 for restraining movement of the second holding elements 14 toward the workpiece 200. The two blocking posts 16 are arranged at two opposite sides of the first supporting bar 11. Each of the blocking posts 16 is arranged between the corresponding second supporting bar 15 and the first supporting bar 11.

The power supply 17 includes an anode terminal 170 and a cathode terminal 172. In this embodiment, the tank 10 is insulated material. Each of the first supporting bar 11, the first holding element 12, the crossbars 13, the second holding elements 14, and the second supporting bars 15 are metallic material. The first supporting bar 11 is connected to the cathode terminal 172. Each of the second supporting bars 15 is connected to the anode terminal 170. The metal block received in the mesh container 140 is made of copper (Cu). The solution 10A contains copper sulfate. In operation, the power supply 17 supplies a direct current to the metal block received in the mesh container 140 through the second supporting bars 15, the second loops 142, and the mesh container 140, oxidizing the copper atoms into copper ions. The copper ions are dissolved in the electrolyte solution 10A. The copper ions in the solution 10A generate a chemical reaction to produce Cu. The produced Cu is gradually deposited on the first and the second surfaces 201, 202 of the workpiece 200. Thus, a copper layer is formed on each of the first and the second surfaces 201, 202.

In this embodiment, a current density applied to the workpiece 200 decreases with distance between a point at each of the first and the second surfaces 201, 202 and the frame 320 increases without the second holding elements 14. That is, the current density applied to the workpiece 200 is non-uniform across the first and the second surfaces 201, 202 without the second holding elements 14. The current density on the edge portion of each of the first and the second surfaces 201, 202 exceeds that of the current density on the center of each of the first and the second surfaces 201, 202. The second holding elements 14 are used to compensate a non-uniform distribution of the current density across each of the first and the second surfaces 201, 202. In this embodiment, the compensation is achieved by adjusting distance between the second holding elements 14 and each of the first and the second surfaces 201, 202. A distance between an edge portion of each of the first and the second surfaces 201, 202 and the first holding element 14 exceeds a distance between a central portion of each of the first and the second surfaces 201, 202 and the first holding element 14. As such, current density across each of the first and the second surfaces 201, 202 is uniform, as is deposition of the copper layer across each of the first and the second surfaces 201, 202. In this embodiment, the titanium layer formed on the surface of the mesh container 140 is configured to avoid deposition of the copper layer thereon.

It is understood that the embodiments disclosed are intended to illustrate rather than limit the disclosure. Variations may be made to the embodiment without departing from the spirit of the disclosure. Accordingly, it is appropriate that the appended claims be construed broadly and in a manner consistent with the scope of the disclosure.

What is claimed is:

1. An electroplating apparatus, comprising:

an electroplating tank for receiving an electrolyte solution;

a first horizontally oriented supporting bar arranged in the electroplating tank;

a first holding element suspended in the tank from the first supporting bar, the first holding element being configured for holding a plate-shaped workpiece in a manner that the workpiece is oriented along the first supporting bar;

two second horizontally oriented supporting bars arranged at opposite sides of the first supporting bar;

a plurality of spaced crossbars each disposed on the two second supporting bars;

a plurality of second holding elements suspended from the corresponding crossbars, each of the second holding elements arranged between the first and one of the second supporting bars and configured for holding a metal block, each of the second holding elements being movable along the corresponding crossbar toward and away from the first supporting bar;

a power supply comprising a cathode for electrical connection to the workpiece through the first supporting bar and the first holding element and an anode for electrically connection to the metal blocks through the second supporting bars and the second holding elements.

2. The electroplating apparatus of claim 1, wherein the distances between the second holding elements and the first holding element gradually increase in directions from a vertical centerline of the first holding element to opposite sides thereof.

3. The electroplating apparatus of claim 2, wherein the first holding element is movable along the first supporting bar.

4. The electroplating apparatus of claim 3, wherein each of the crossbars is movable along a lengthwise direction of the first supporting bar.

5. The electroplating apparatus of claim 3, wherein the second holding elements are arranged at opposite sides of the first holding element.

6. The electroplating apparatus of claim 5, wherein the crossbars are parallel to each other and perpendicular to the first supporting bar.

7. The electroplating apparatus of claim 1, wherein each of the second holding elements comprises a mesh container receiving the metal block.

8. The electroplating apparatus of claim 7, wherein the mesh container comprises a plurality of metallic wires and a titanium layer formed thereon.

9. The electroplating apparatus of claim 1, wherein the first holding element comprises a loop for mounting the workpiece.

10. An electroplating apparatus, comprising:

an electroplating tank containing an electrolyte solution;

a first horizontally oriented supporting bar arranged in the electroplating tank;

a first holding element suspended in the electrolyte solution from the first supporting bar, the first holding element being configured for holding a plate-shaped workpiece in a manner that the workpiece is oriented along the first supporting bar;

two second horizontally oriented supporting bars arranged at opposite sides of the first supporting bar;

a plurality of spaced crossbars each disposed on the two second supporting bars;

a plurality of second holding elements suspended from the corresponding crossbars, the second holding elements arranged at opposite sides of the first holding element and located between the second supporting bars, the second holding element holding a plurality of metal blocks immersed in the electrolyte solution;

a power supply comprising a cathode for electrical connection to the workpiece through the first supporting bar and the first holding element and an anode for electrical connection to the metal blocks through the second supporting bars and the second holding elements.

11. The electroplating apparatus of claim 10, wherein the distances between the second holding elements and the first holding element gradually increase in directions from a vertical centerline of the first holding element to opposite sides thereof.

12. The electroplating apparatus of claim 11, wherein the first holding element is movable along the first supporting bar.

13. The electroplating apparatus of claim 12, wherein each of the crossbars is movable along a lengthwise direction of the first supporting bar.

14. The electroplating apparatus of claim 10, wherein the crossbars are parallel to each other and perpendicular to the first supporting bar.

15. The electroplating apparatus of claim 10, wherein each of the second holding elements comprises a mesh container receiving the metal block.

16. The electroplating apparatus of claim 15, wherein the mesh container comprises a plurality of metallic wires and a titanium layer formed thereon.

17. The electroplating apparatus of claim 10, wherein the first holding element comprises a loop for mounting the workpiece.

* * * * *